US006502535B2

(12) United States Patent
Nakamura

(10) Patent No.: US 6,502,535 B2
(45) Date of Patent: Jan. 7, 2003

(54) VALVE TIMING AND LIFT CONTROL SYSTEM

(75) Inventor: Makoto Nakamura, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/880,838

(22) Filed: Jun. 15, 2001

(65) Prior Publication Data

US 2001/0052331 A1 Dec. 20, 2001

(30) Foreign Application Priority Data

Jun. 15, 2000 (JP) ..... 2000-179510

(51) Int. Cl.[7] ..... F10L 1/34

(52) U.S. Cl. ..... 123/90.15; 123/90.16; 123/90.17; 123/90.23; 123/90.27; 123/90.31

(58) Field of Search ..... 123/90.16, 90.17, 123/90.18, 90.27, 90.39, 90.15, 90.23

(56) References Cited

U.S. PATENT DOCUMENTS 5,074,260 A * 12/1991 Yagi et al. ..... 123/90.16
5,355,849 A * 10/1994 Schiattino ..... 123/90.17
5,367,991 A * 11/1994 Asai et al. ..... 123/90.16
5,592,906 A * 1/1997 Kreuter et al. ..... 123/90.16
5,937,809 A * 8/1999 Pierik et al. ..... 123/90.16
6,019,076 A * 2/2000 Pierik et al. ..... 123/90.16
6,055,949 A * 5/2000 Nakamura et al. ..... 123/90.16
6,202,610 B1 * 3/2001 Yoshiki et al. ..... 123/90.15
6,244,230 B1 * 6/2001 Mikame ..... 123/90.17
6,311,659 B1 * 11/2001 Pierik ..... 123/90.24
6,401,675 B1 6/2002 Nakamura et al. ..... 123/90.15

FOREIGN PATENT DOCUMENTS

DE 3904681 A1 * 8/1990 ..... 123/90.48
JP 61190118 A 8/1986

* cited by examiner

*Primary Examiner*—Thomas Denion
*Assistant Examiner*—Ching Chang
(74) *Attorney, Agent, or Firm*—Foley & Lardner

(57) ABSTRACT

A variable valve timing and lift control system for an internal combustion engine is provided which comprises a first control mechanism for variably controlling a valve lift and an operation angle of an exhaust valve of the engine, a second control mechanism for variably controlling a maximum lift phase of the exhaust valve, a detector for detecting an operating condition of the engine and producing a signal representative thereof, and a controller for controlling the first control mechanism and the second control mechanism in response to the signal from the detector.

22 Claims, 8 Drawing Sheets

VALVE TIMING AND LIFT CONTROL SYSTEM

BACKGROUND OF THE INVENTION

The present invention relates to valve timing and lift control systems in internal combustion engines and, more particularly, to a valve timing and lift control system having a first control mechanism for controlling the lift and operation angle of exhaust valves and a second control mechanism for controlling a maximum lift phase (crankshaft phase at which the lift of an associated exhaust valve or valves becomes maximum).

The valve timing and lift control system for variably controlling the opening and closing timings of exhaust valves according to an operating condition of an engine is well known in the art and disclosed, for example, in Japanese Patent Provisional Publication No. 61-190118.

The valve timing and lift control system is adapted to control the exhaust valves in such a manner as to advance the opening and closing timings of the exhaust valves while keeping the magnitude of maximum lift and operation angle constant. By advancing the opening timing of the exhaust valves, exhaust of the engine is accomplished during the time the expansion rate is small. This makes it possible to attain a higher exhaust gas temperature so that the temperature of the catalyst in the exhaust system can be raised rapidly. The catalyst thus can be activated rapidly and therefore the toxic exhaust emission from the catalytic converter can be reduced.

SUMMARY OF THE INVENTION

The present invention provides a modified valve timing and lift control system of the type described above but having additional features which will be understood as the description proceeds further.

According to an aspect of the present invention, there is provided a variable valve timing and lift control system for an internal combustion engine comprising a first control mechanism for variably controlling a valve lift and an operation angle of an exhaust valve of the engine, a second control mechanism for variably controlling a maximum lift phase of the exhaust valve, a detector for detecting an operating condition of the engine and producing a signal representative thereof, and a controller for controlling the first control mechanism and the second control mechanism in response to the signal from the detector.

According to another aspect of the present invention, there is provided a variable valve timing and lift control system for an internal combustion engine comprising a drive shaft rotatable in timed relation to a revolution of the engine, an oscillating cam mounted on the drive shaft for oscillating motion and operatively engaging an exhaust valve of the engine for opening and closing the exhaust valve when oscillates, a connecting device for drivingly connecting the drive shaft to the oscillating cam in such a manner as to convert rotation of the drive shaft to oscillating motion of the oscillating cam, a first control device for varying engagement of the oscillating cam with the exhaust valve for thereby varying a lift and an operation angle of the exhaust valve, and a second control device for varying a phase of the drive shaft and thereby varying a maximum lift phase of the exhaust valve.

These and other features and advantages of this invention will become understood from the following description with reference to the accompanying drawings.

DESCRIPTION OF THE PREFERRED EMBODIMENT

While the above described valve timing and lift control system disclosed, for example, in Japanese Patent Provisional Publication No. 61-190118 can variably control the opening and closing timing of the exhaust valves as described above, it cannot sufficiently produce a desired effect, i.e., a desired effect of reducing toxic exhaust emission when the engine is cold. When the opening timing of the exhaust valves becomes earlier, high temperature combustion gas within the combustion chamber is released to the exhaust system at an earlier timing. Accordingly, the warming up efficiency of the engine itself is lowered, resulting in that a deterioration of combustion is incurred and a period during which an exhaust gas of a high concentration of unburnt gas is emitted from the combustion chamber. For this reason, while a rapid rise of the temperature of the catalyst can be attained, a larger amount of combustible mixture is contained in the exhaust gas and supplied to the catalyst. Thus, it becomes impossible to sufficiently decrease the toxic exhaust emission from the catalytic converter to the atmosphere.

Further, since the warming up efficiency of the engine itself is lowered, a rise of coolant temperature is slow, thus deteriorating the heating efficiency of the passenger compartment.

Figure 1:
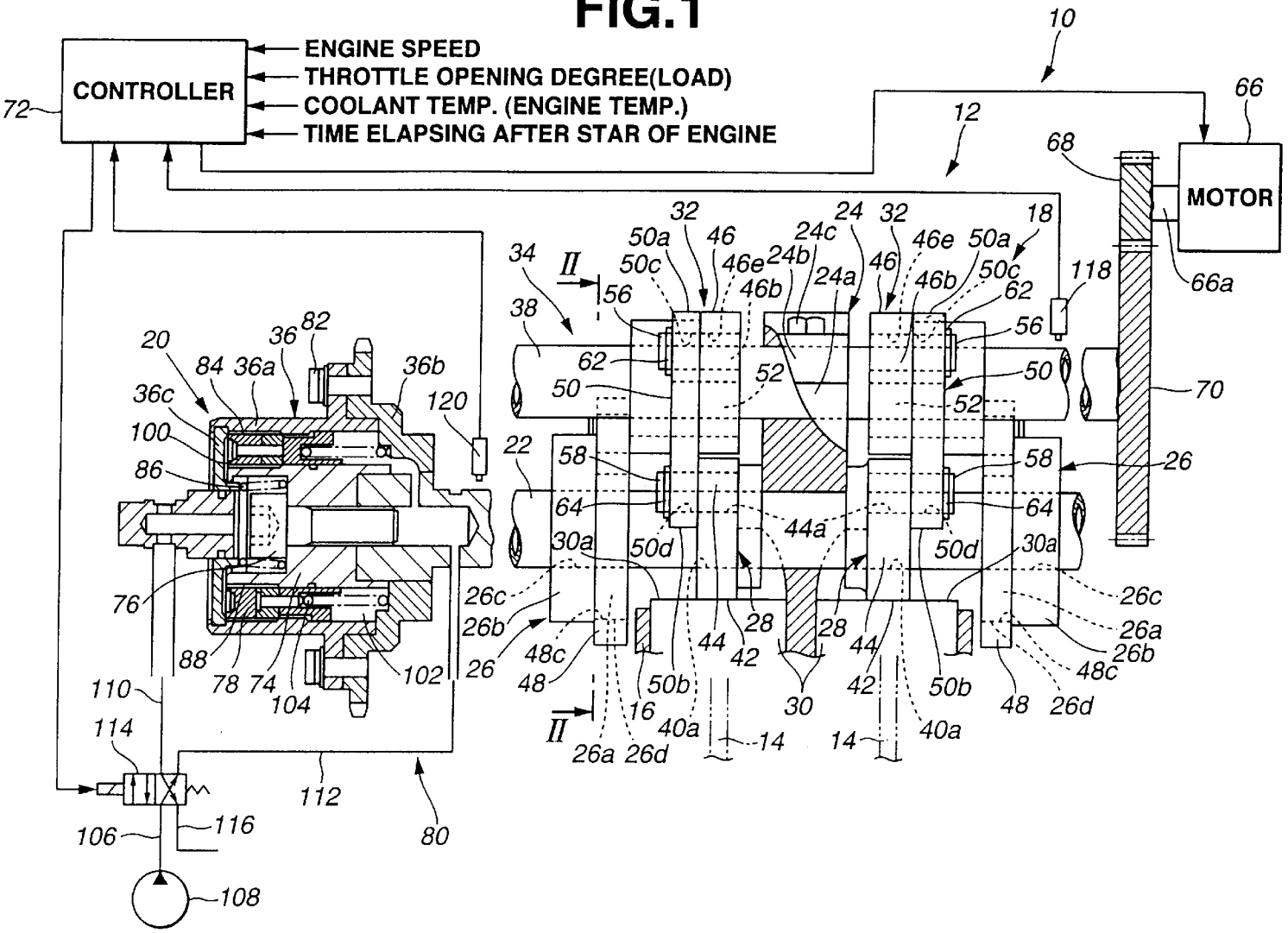
FIG. 1 is a schematic, partly sectional, side elevation of a portion of an internal combustion engine having a valve timing and lift control system according to an embodiment of the present invention.

Referring now to FIG. 1, numeral 10 generally indicates a portion of an internal combustion engine including a valve timing and lift control system 12 operative to actuate a pair of exhaust valves 14 and 14 provided to each cylinder of the engine 10. The exhaust valves 14 and 14 are reciprocatively mounted on a cylinder head 16 of the engine 10 by means of valve guides (not shown). The valve timing and lift control system 12 includes a first control mechanism 18 for variably controlling the valve lift and operation angle of each of the exhaust valves 14 and 14 in accordance with an operating condition of the engine 10 and a second control mechanism 20 for variably controlling the maximum lift phase of each of the exhaust valves 14 and 14, i.e., a crankshaft phase angle at which the valve lift becomes maximum.

Figure 2:
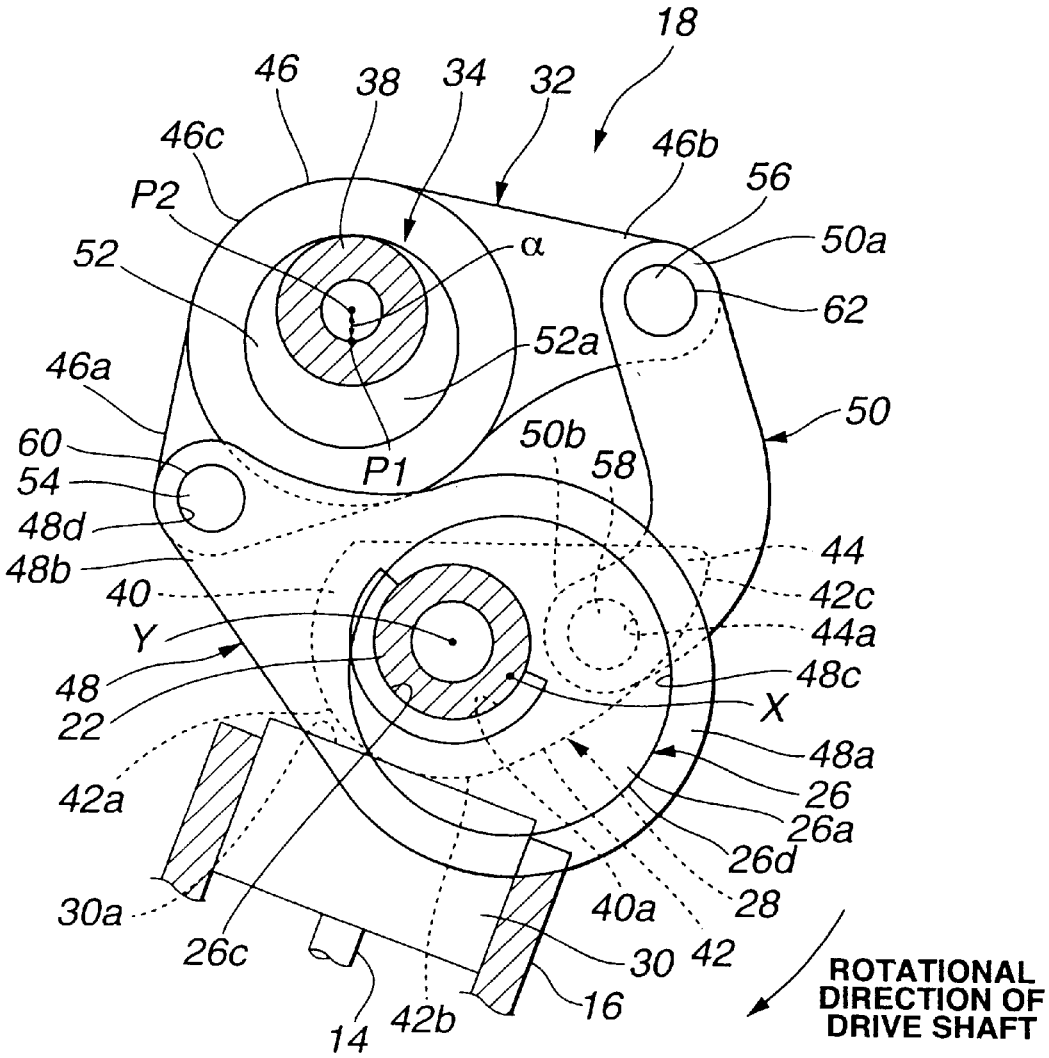
FIG. 2 is a sectional view taken along the line II—II in FIG. 1.
Figure 3:
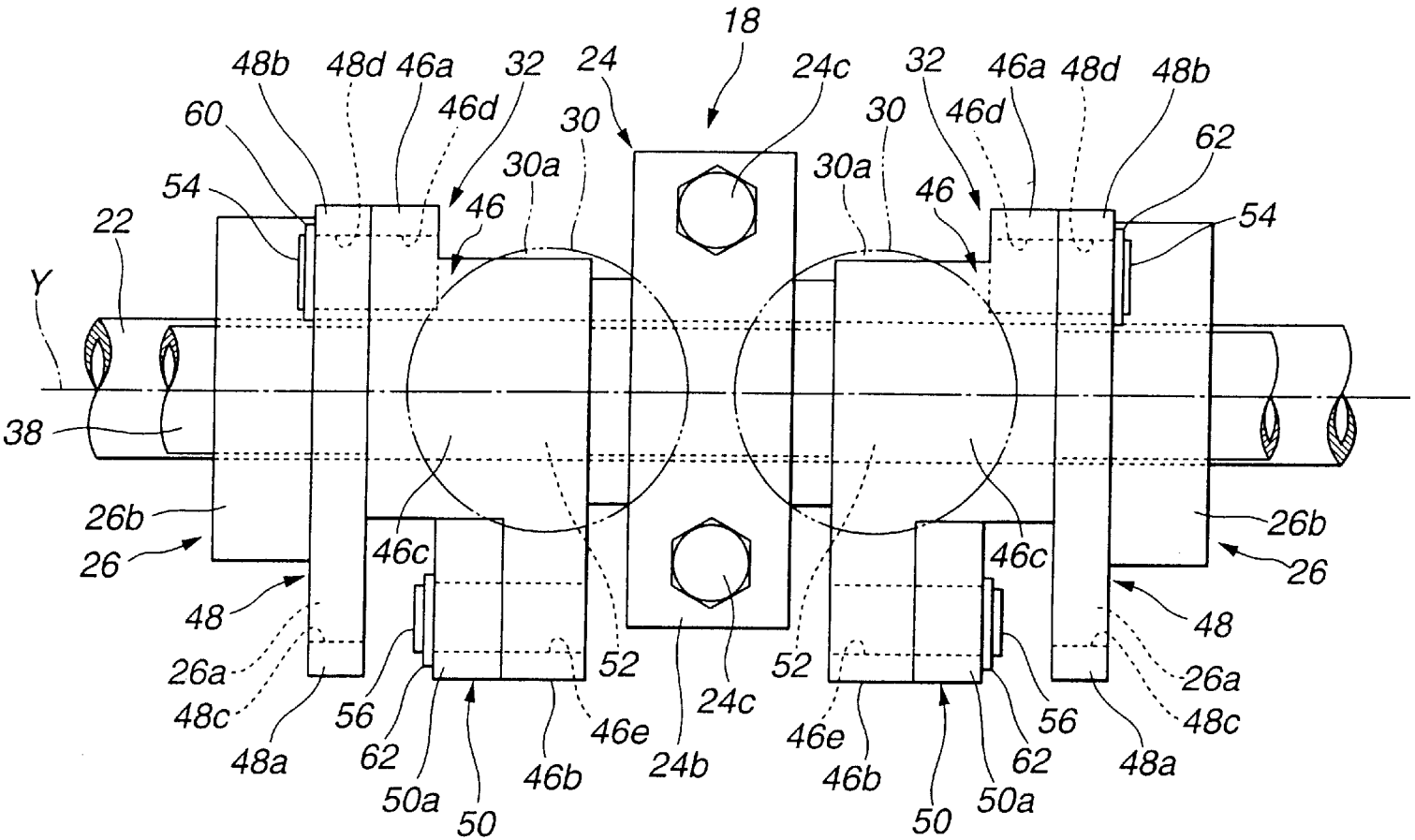
FIG. 3 is a plan view of a first control mechanism of the valve timing and lift control system of FIG. 1.

As shown in FIGS. 1 to 3, the first control mechanism 18 includes a hollow drive shaft 22 rotatably supported on the cylinder head 16 by means of a bearing 24, a pair of drive cams 26 and 26 which are in the form of an eccentric cam and force-fitted or otherwise fixedly mounted on the drive shaft 22, a pair of oscillating cams 28 and 28 engaging slidably with upper flat surfaces 30*a* and 30*a* of valve lifters 30 and 30 which are disposed at respective upper ends of the exhaust valves 14 and 14, for actuating the exhaust valves 14 and 14 to open, a pair of connecting devices 32 and 32 drivingly connecting the drive cams 26 and 26 to the respective oscillating cams 28 and 28 in such a manner as to convert rotation of the drive cams 26 and 26 to oscillating motion of the oscillating cams 28 and 28 and a control device 34 for variably controlling the operations of the connecting devices 32 and 32.

The drive shaft 22 is disposed so as to extend in the front-to-rear direction of the engine 10, i.e., in the direction in which a crankshaft (not shown) extends, and connected at an end to a timing sprocket 36 of the second control mechanism 20. By this, a driving force is transmitted from an engine crankshaft (not shown) to the drive shaft 22 by way of a timing chain (not shown) wound around the timing sprocket 36.

As shown in FIG. 1, the bearing 24 includes a main bracket 24*a* disposed on an upper end portion of the cylinder head 16 to rotatably support the drive shaft 22, and an auxiliary bracket 24*b* disposed on the upper end portion of the main bracket 24*a* to rotatably support a control shaft 38 which will be described hereinlater. The both brackets 24*a* and 24*b* are fastened to the cylinder head 16 by means of a pair of bolts 24*c* and 24*c*.

As shown in FIGS. 1 to 3, each drive cam 26 is generally ring-shaped and includes a cam main body 26*a* in the form of a circular disk and a tubular portion 26*b* located at an axial end of the cam main body 26*a* and formed integral with the same. The drive cam 26 has an axial through hole 26*c* through which the drive shaft 22 extends. The cam main body 26*a* has a geometric center axis X which is offset radially from a rotational axis Y of the drive shaft 22 by a predetermined amount. Further, each drive cam 26 is fixedly attached to the drive shaft 22 by force-fitting the drive shaft 22 in the through hole 26*c*. Both of the cam main bodies 26*a* and 26*a* have circular outer peripheral surfaces 26*d* and 26*d* which are formed into the same cam profile.

As shown in FIG. 2, the oscillating cam 28 is nearly U-shaped and has an annular base portion 40 formed with a retaining hole 40*a*. The drive shaft 22 is inserted into the retaining hole 40*a* and rotatably supports thereon the oscillating cam 28. The oscillating cam 28 further has a nose portion 44 formed with a pin hole 44*a*. Further, the oscillating cam 28 has at a lower side thereof a cam surface 42 consisting of a basic circular or dwell surface portion 42*a* disposed at the lower side of the base portion 40, an arcuated ramp surface portion 42*b* extending from the basic circular surface portion 42*a* toward the cam nose portion 44, and a lift or rise surface portion 42*c* disposed on the lower side of the- cam nose portion 44. The basic circular surface portion 42*a,* ramp surface portion 42*b* and lift surface portion 42*c* are selectively brought into contact with the upper surface 30*a* of the valve lifter 30 in accordance with the rotational position of the oscillating cam 28.

As shown in FIG. 2, each connecting device 32 includes a rocker arm 46 disposed above the drive shaft 22, a pivotal link 48 connecting between an end portion 46*a* of the rocker arm 46 and the drive cam 26, and a connecting rod 50 connecting between another end portion 46*b* of the rocker arm 46 and the oscillating cam 28.

As seen from FIG. 3, the rocker arm 46 has a crank-like shape when observed in plan and is rotatably supported at a tubular base portion 46*c* on a control cam 52 which will be described hereinlater. As shown in FIGS. 2 and 3, the end portion 46*a* of each rocker arm 46 is formed with a pin hole 46*d* in which a pin 54 for relatively rotatably connecting the end portion 46*a* of the rocker arm 46 to the pivotal Link 48 is inserted and fixedly held. The other end portion 46*b* of each rocker arm 46 is formed with a pin hole 46*e* in which a pin 56 for relatively rotatably connecting the other end portion 46*b* of each rocker arm 46 to one end 50*a* of the connecting rod 50 is inserted and fixedly held.

The pivotal link 48 includes an annular base portion 48*a* and a protruded arm portion 48*b* protruding radially outward from the base portion 48*a*. The base portion 48*a* has at the center thereof a hole 48*c* in which the cam main body 26*a* of the drive cam 26 is rotatably installed. The protruded arm portion 48*b* has a pin hole 48*d* in which the pin 54 is rotatable held.

As shown in FIG. 2, the connecting rod 50 has an angled or bent shape and has at opposite end portions 50*a* and 50*b* thereof pin insertion holes 50*c* and 50*d* (FIG. 1) in which the pin 56 fixedly held in the pin hole 46*e* (FIG. 1 or 3) of the end portion 46*b* of the rocker arm 46 and a pin 58 fixedly held in the pin hole 44*a* of the cam nose portion 44 of the oscillating cam 28 are respectively held rotatably.

The connecting rod 50 restricts the maximum pivotal range of the oscillating cam 28 within the pivotal range of the rocker arm 46.

As shown in FIGS. 1 and 3, the pins 54, 56 and 58 have at one end thereof snap rings 60, 62 and 64 for restricting movement of the pivotal link 48 and connecting rod 50 in the axial direction of the pins 54, 56 and 58.

The control device 34 is made up of the control shaft 38 disposed so as to extend in the front-to-rear direction of the engine, the control cam 52 mounted on the control shaft 38 for rotation therewith and rotatably supporting thereon the rocker arm 46, and an electric motor 66 for variably controlling the rotational position of the control shaft 38.

The control shaft 38 is disposed in parallel with the drive shaft 22 and between the main bracket 24*a* and the secondary bracket 24*b* so as to be rotatably supported by the same. On the other hand, each control cam 52 is hollow cylindrical and has a geometric center axis P1 which is offset from a rotational axis P2 of the control shaft 38 by the amount $\alpha$.

The electric motor 66 transmits a driving force to the control shaft 38 by way of a first spur gear 68 provided to an end portion of a drive shaft 66*a* and a second spur gear 70 provided to a rear end portion (i.e., a right-hand end portion in FIG. 1) of the control shaft 38. The electric motor 66 drives the control shaft 38 in response to a signal from a controller 72. The controller 72 detects an operating condition of the engine 10 and produces a signal to be supplied to the electric motor 66, on the basis of the detected operating condition.

As shown in FIG. 2, the second control mechanism 20 consists of the timing sprocket 36 provided to a front end portion (i.e., a left-hand end portion in FIG. 1) of the drive shaft 22 to which a driving force is transmitted from the crankshaft (not shown) of the engine 10 by way of the timing chain (not shown), a sleeve 74 fixedly attached to the front end portion of the drive shaft 22 by a bolt 76 extending axially of the drive shaft 22, a hollow, cylindrical gear 78 interposed between the timing sprocket 36 and the sleeve 74, and a hydraulic circuit 80 which constitutes a drive for driving the hollow, cylindrical gear 78 axially of the drive shaft 22.

The timing sprocket 36 has a hollow, cylindrical main body portion 36*a* and a sprocket portion 36*b* fixedly attached to the main body portion 36*a* by means of bolts 82. Around the sprocket portion 36*b* is wound the aforementioned timing chain (not shown). The timing sprocket 36 further has a front cover 36*c* which closes a front end opening of the main body portion 36*a*. Further, the main body portion 36*a* has an internal, helical gear teeth 84 on the inner circumferential surface thereof.

The sleeve 74 has at a rear end portion thereof (i.e., a right-hand end portion in FIG. 1) an axial depression (no numeral) in which the front end portion of the drive shaft 22 is fitted. The sleeve 74 further has at a front end potion thereof (i.e., a left-hand end portion in FIG. 1) an axial depression (no numeral) in which a coil spring 86 for urging the timing sprocket 36 forward (i.e., in the left-hand direction in FIG. 1) by way of the front cover 36*c* is disposed. Further, the sleeve 74 has on the outer circumferential surface external, helical gear teeth 88.

The hollow, cylindrical gear 78 is axially divided into two sections which are axially urged toward each other by means of, though not shown, pins and springs. Further, the gear 78 has on the inner and outer circumferential surfaces thereof internal helical gear teeth and external helical gear teeth meshed with the inner gear teeth 84 and the outer gear teeth 88, respectively. The gear 78 is axially movable in response to a difference of oil pressure supplied to first and second oil pressure chambers 100 and 102 which are formed on the axially opposite sides thereof, with the internal and external helical gear teeth being held in sliding engagement with the inner and outer gear teeth 84 and 88, respectively. The gear 78 controls the exhaust valves 14 and 14 in such a manner as that the exhaust valves 14 and 14 are set or regulated to maximumly advanced positions when moved into the most forward position (i.e., the leftmost position in FIG. 1) and to maximumly retarded positions when moved into in the most rearward position (i.e., the rightmost position in FIG. 1). Further, the gear 78 is urged by a return spring 104 disposed in the second oil pressure chamber 102 into the most forward position when the first oil pressure chamber 100 is not supplied with any oil pressure, e.g., at start of the engine 10.

The hydraulic circuit 80 consists of a main gallery 106 disposed downstream of an oil pump 108 which is in communication with an oil pan (not shown), first and second oil pressure passages 110 and 112 into which a downstream portion of the main gallery 106 is bifurcated and which are fluidly connected to the first and second oil pressure chambers 100 and 102, respectively, a directional control valve 114 disposed at a position where the downstream portion of the main gallery 106 is bifurcated, and a drain passage 116 fluidly connected to the directional control valve 114.

The directional control valve 114 is controlled in response to a signal from the controller 72 which is also used for controlling the electric motor 66 of the first control mechanism 18.

The controller 72 detects, by calculation or the like, an operating condition of the engine 10 on the basis of signals from various sensors, e.g., an engine speed signal from a crank angle sensor (not shown), a throttle opening degree signal from a throttle opening degree sensor (not shown), an engine temperature signal from a coolant temperature sensor (not shown). At the same time, the controller 72 produces control signals on the basis of detection signals from a first position detecting sensor 118 for detecting a rotational position of the control shaft 38 and a second rotational position sensor 120 for detecting a rotational position of the drive shaft 22 relative to the timing sprocket 36 and supplies the control signals to the electric motor 66 and the directional control valve 114, respectively.

The controller 72 determines target valve lift characteristics (lift, operation angle, and maximum lift phase) of the exhaust valves 14 and 14 in response to signals representative of information such as engine speed, throttle opening degree corresponding to load, coolant temperature corresponding to engine temperature and time elapsing after start of engine, and controls the first control mechanism 18 and the second control mechanism 20 in such a manner as to make the actual valve lift characteristics become equal to the target valve lift characteristics.

In operation of the first control mechanism 18, the controller 72 determines a target rotational position of the control shaft 38 that can attain a target valve lift and a target operation angle and produces a signal representative of same. In response to this signal, the electric motor 66 is actuated to drive the control cam 52 into a predetermined rotational position by way of the control shaft 38. Further, by the first positional sensor 118, the rotational position of the control shaft 38 is monitored to carry out a feedback control for driving the control shaft 38 into the target phase.

In operation of the second control mechanism 20, the controller 72 determines a target retard angle of the drive shaft 22 (i.e., a target twist angle relative to the timing sprocket 36) that makes a maximum lift phase (i.e., crankshaft phase at which the lift becomes maximum) be equal to a target maximum lift phase and produces a signal representative of same. In response to this signal, the directional control valve 114 is operated to provide communication between the first oil pressure passage 110 and the main gallery 106. By this, the rotational position of the drive shaft 22 relative to the timing sprocket 36 is varied by way of the cylindrical gear 78 and regulated to a retard angle side. In this case, the actual rotational position of the drive shaft 22 relative to the timing sprocket 36 is monitored by the second positional sensor 120 and feedback controlled so that the drive shaft 22 is rotated into a target displacement position, i.e., so as to attain a target retard angle.

The maximum lift phase shows such a peculiar variation that will be described hereinlater, in response to an operation of the drive shaft 22. However, on consideration of this fact is determined the target retard angle of the drive shaft 22, so that there is not caused any problem. Namely, the peculiar variation is made harmless.

The operation of the valve timing and lift control system 12 will be described hereinlater. Firstly, a basic operation of the first control mechanism 18 and the second control mechanism 20 will be described.

Figure 5:
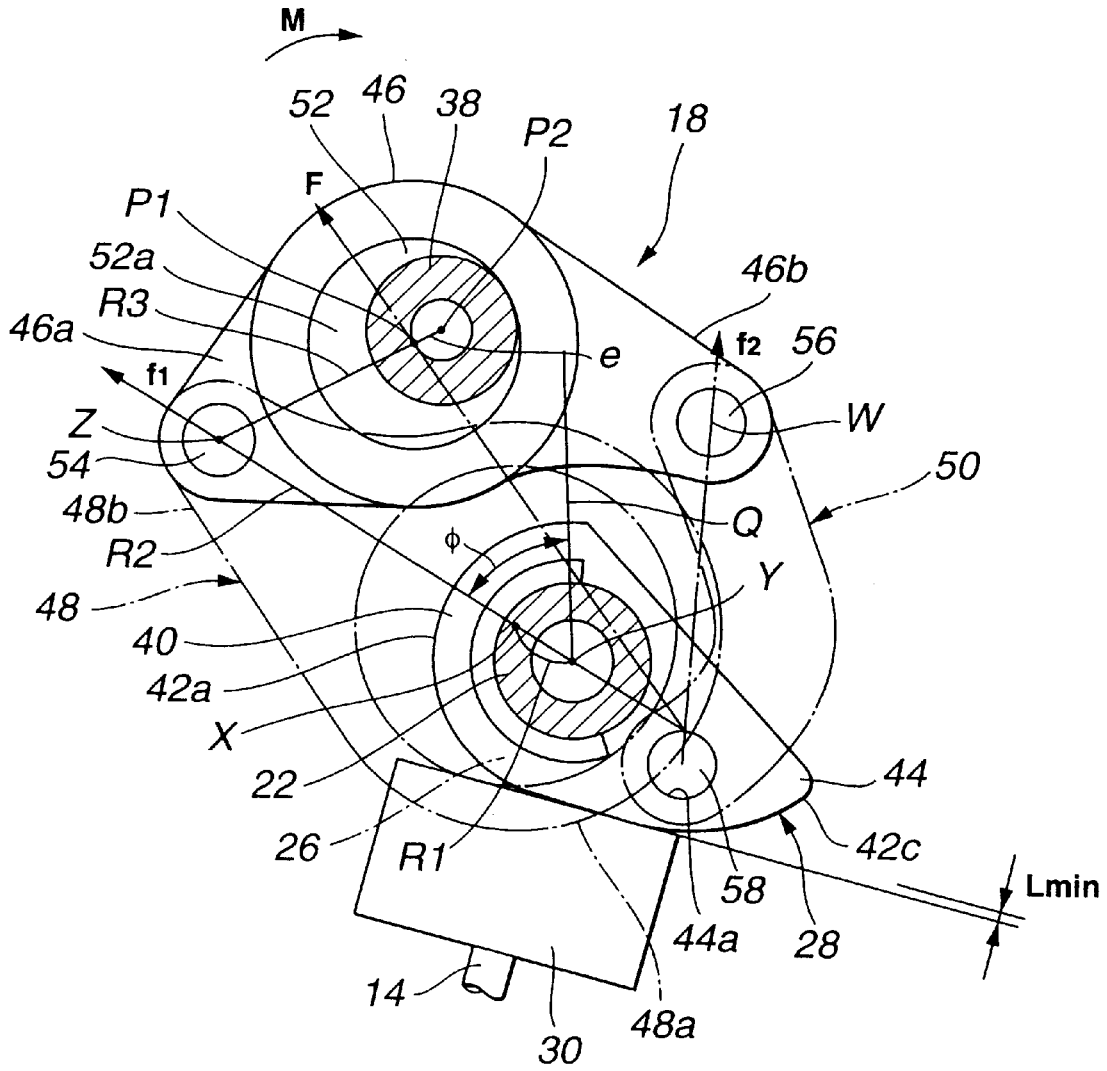
Figure 6:
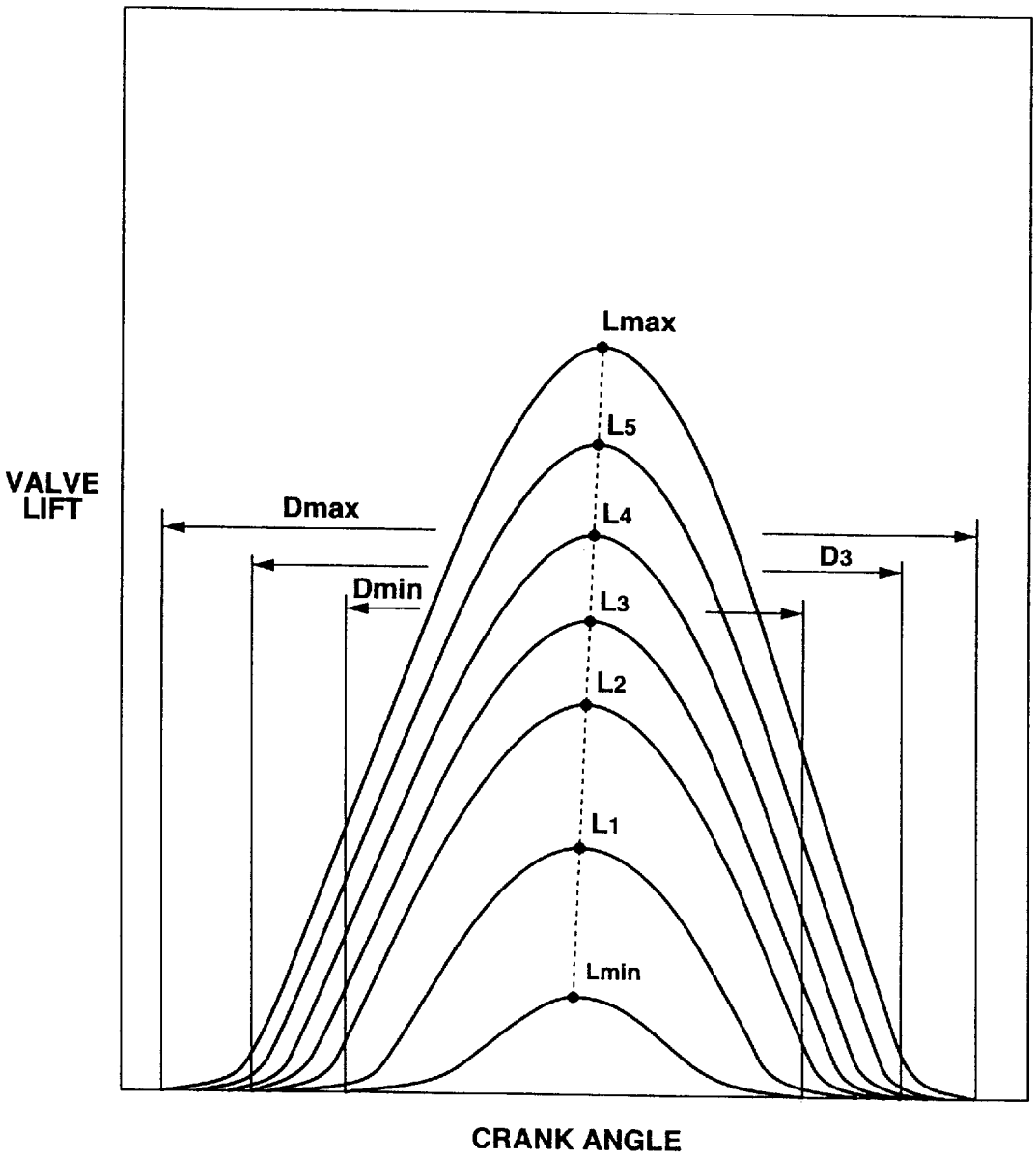
FIG. 6 is a graph illustrating valve timing and lift characteristic curves provided by the first control mechanism of the valve timing and lift control system of FIG. 1.

In operation of the first control mechanism 18, for example, at a low speed and low load engine operating condition, the control shaft 38 is driven by the electric motor 66 and caused to rotate in one direction in response to a control signal from the controller 72. By this, as shown in FIG. 5, the geometric center axis P1 of the control cam 52 is turned into a position off to the lower left of the rotational axis P2 of the control shaft 38 and a lift portion 52*a* of the control cam 52 is moved upward away from the drive shaft 22. By this, the rocker am 46 is moved bodily upward relative to the drive shaft 22. Due to this, each oscillating cam 28 is forcedly pulled upward by way of the connecting rod 50 and caused to turn anticlockwise. Accordingly, when the drive cam 26 is rotated to push the end portion 46*a* of the rocker arm 46 upward by way of the pivotal link 48, this lift is transmitted to the oscillating cam 28 and the valve lifter 30 so as to attain a minimum lift (Lmin) as shown in FIGS. 5 and 6.

Further, when the operating condition of the engine 10 is varied and the engine 10 is put into a high speed and high load engine operating condition, the control shaft 38 is driven by the electric motor 66 in the other direction (i.e., the direction opposite to the above described one direction) in response to a control signal from the controller 72. By this, the control cam 52 is rotated into the position shown in FIG. 4, thus causing the lift portion 52*a* of the control cam 52 to move downward. The rocker arm 46 is thus bodily moved toward the drive shaft 22 (i.e., downward) while causing the other end portion 46*b* thereof to push pressure passage 110 and the drain passage 116 for a predetermined time. By this, the cylindrical gear 78 is moved forward or rearward, thus varying the rotational position of the drive shaft 22 relative to the timing sprocket 36 and thereby causing the valve timing to vary toward the maximum advance side or to the maximum retard side continuously (refer to the dotted line and solid line curves in FIG. 8). In this instance, the actual relative rotational position of the drive shaft 22 is monitored by the second positional sensor 120 and the drive shaft 22 is feedback controlled so as to be rotated into a target relative rotational position, i.e., a position where a target advance angle is attained.

Figure 8:
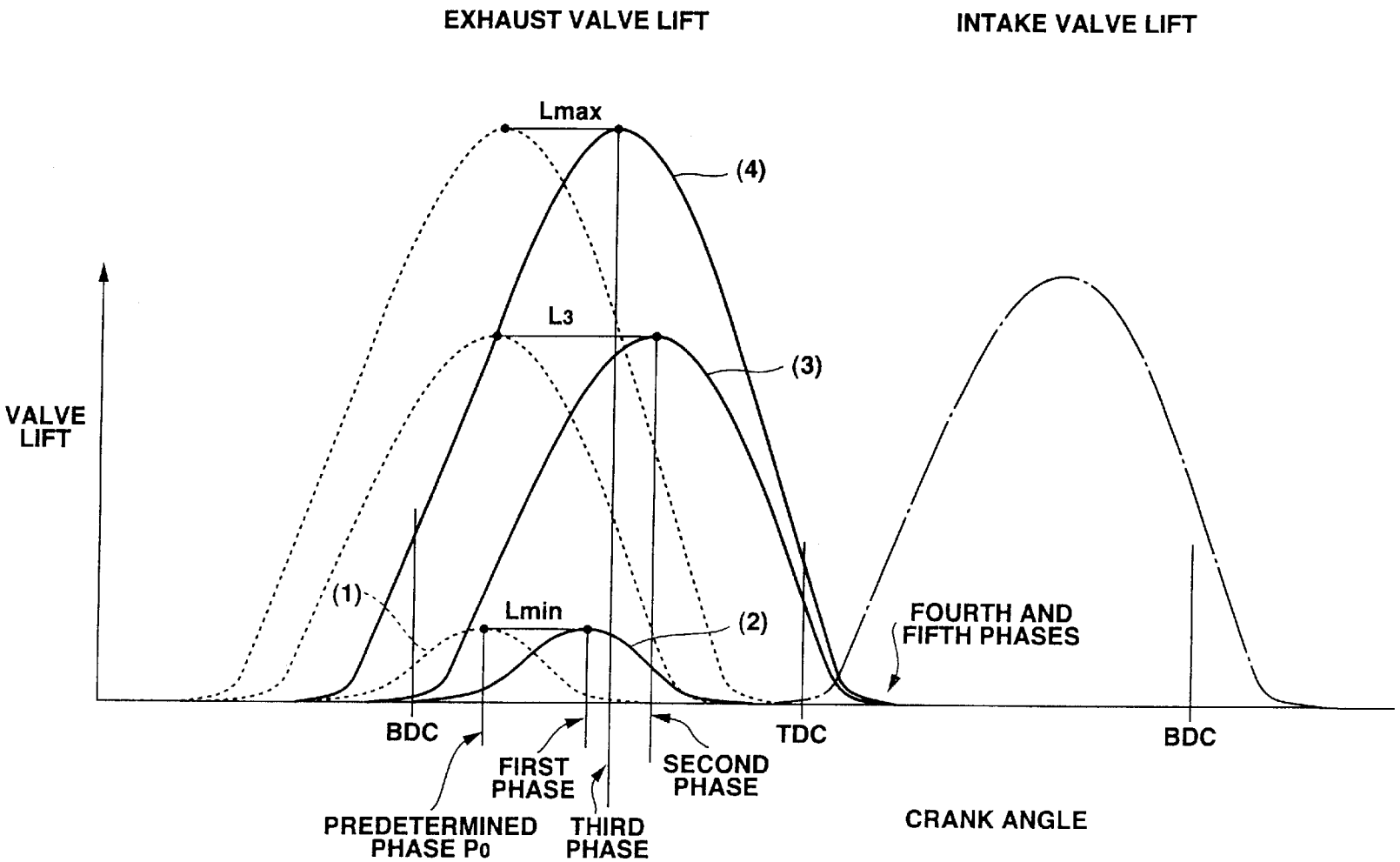
FIG. 8 is a graph illustrating valve timing and lift characteristic curves provided by the first control mechanism and a second control mechanism of the valve timing and lift control system of FIG. 1.

At the moment the engine 10 is started, i.e., at the time of cranking of the engine 10, the valve timing and lift control system 12 has such valve lift characteristics represented by the dotted line curve (1) in FIG. 8. Namely, the first control mechanism 18 allows the lift of the exhaust valve to be nearly equal to the minimum value Lmin. On the other hand, the second control mechanism 20 allows the opening and closing timings of the exhaust valves 14 and 14 to be in the nearly most advanced state and the phase of the valve lift characteristics to be near the most advance angle.

Figure 4:
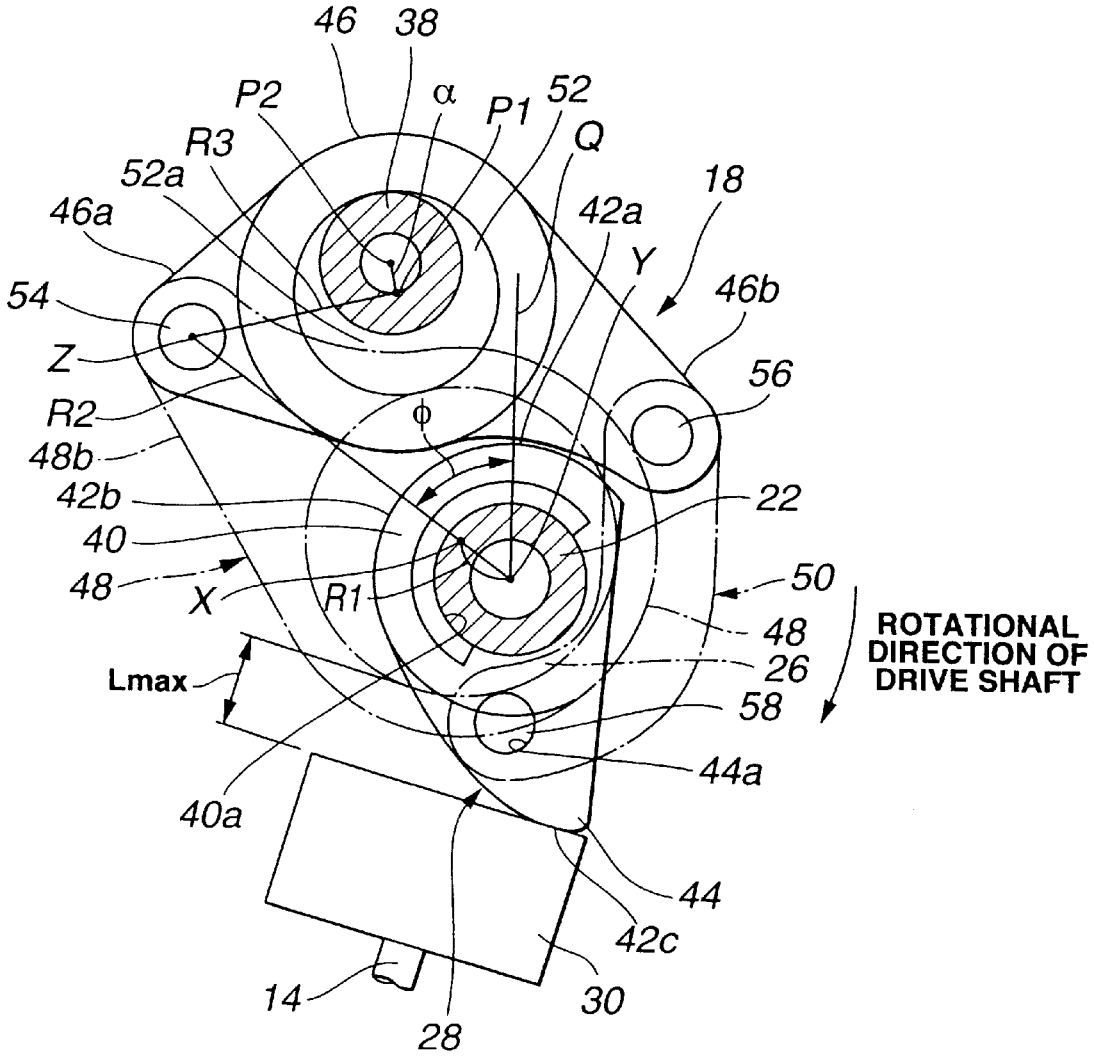
FIGS. 4 and 5 are views similar to FIG. 2 but show a maximum lift control and a minimum lift control by the first control mechanism of FIG. 3, respectively.

More specifically, immediately after the engine 10 is switched off, supply of power to the electric motor 66 is interrupted, thus causing the first control mechanism 18 to be put into an Off condition. The control shaft 38 is subjected to a moment in the clockwise direction in the figure as FIG. 2 under the bias of valve springs (not shown). Due to this, the control shaft 38 is rotated clockwise into a rotational position which is adjacent a rotational position where the minimum lift is attained and held stably thereat. After the control shaft 38 is so rotated, the engine 10 halts. In FIG. 5, as a reaction force the oscillating cam 28 by way of the connecting rod 50, thus causing the oscillating cam 28 to turn clockwise a predetermined amount, i.e., into the position shown in FIG. 4. Accordingly, when the drive cam 26 is rotated to push one end portion 46*a* of the rocker arm 46 by way of the pivotal link 48, this lift is transmitted to the oscillating cam 28 and the valve lifter 30 by way of the connecting rod 50 so as to attain a maximum lift (Lmax) as shown in FIGS. 4 and 6.

The valve lift L and the valve operation angle D are controlled continuously from the minimum lift Lmin to the maximum lift Lmax and from the minimum valve operation angle Dmin to the maximum valve operation angle Dmax by means of the first control mechanism 18 in accordance with the operating condition of the engine as shown in FIG. 6.

In this instance, it is to be noted that a variation of the valve lift L causes a variation of the maximum lift phase. This is caused due to the structure of the first control mechanism 18, i.e., due to the fact that the angle $\phi$ in FIGS. 4 and 5 (i.e., the angle which the line YXZ forms with the vertical line Q when the valve lift becomes maximum) varies with a variation of the phase of the control shaft 38. However, since the maximum Lift phase is set at a suitable value by the second control mechanism 20, there is not caused any problem.

In operation of the second control mechanism 20, a target retard angle of the drive shaft 22 is determined by the controller 72 in response to signals from various sensors. In response to a signal from the controller 72, the directional control valve 114 provides communication between the first oil pressure passage 110 and the main gallery 106 and between the second oil pressure passage 112 and the drain passage 116 for a predetermined time, or provides communication between the second oil pressure passage 112 and the main gallery 106 and also between the first oil of a valve spring (not shown), a load vector f2 acts upon the other end portion 46*b* of the rocker arm 46 and a load vector f1 acts upon one end portion 46*a* of the rocker arm 46 to balance with the load vector f2, so that a load vector F which is equated to a resultant of the load vector f1 and the load vector f2 acts upon the pivotal axis P2 of the rocker arm 46.

Accordingly, by the load vector F, the control cam 52 is subjected to a moment M in the clockwise direction about the pivotal axis P2. Namely, the control cam 52 receives a moment in the direction to be twisted toward a rotational position where a minimum lift is attained.

The second control mechanism 20 is caused to halt when an engine oil pressure which lowers with lowering of the engine speed becomes lower than a certain value, thus causing the cylindrical gear 78 to be moved into a position adjacent the most forward position and allowing the phase of the drive shaft 22 to be held stably adjacent the most advance angle. After the cylindrical gear 78 is so moved, the engine 10 is caused to halt.

Accordingly, as mentioned above, at the moment of start of the engine 10, the lift is set at the minimum lift Lmin, and the maximum lift phase is set at a point adjacent a predetermined phase $P_0$ which is the most advance angle.

For this reason, when a starter motor (not shown) is operated to start the engine 10, the engine speed rises smoothly since a moving valve friction is small when the valve lift is adjacent the minimum lift Lmin, thus making it possible to attain a good startability.

Figure 7:
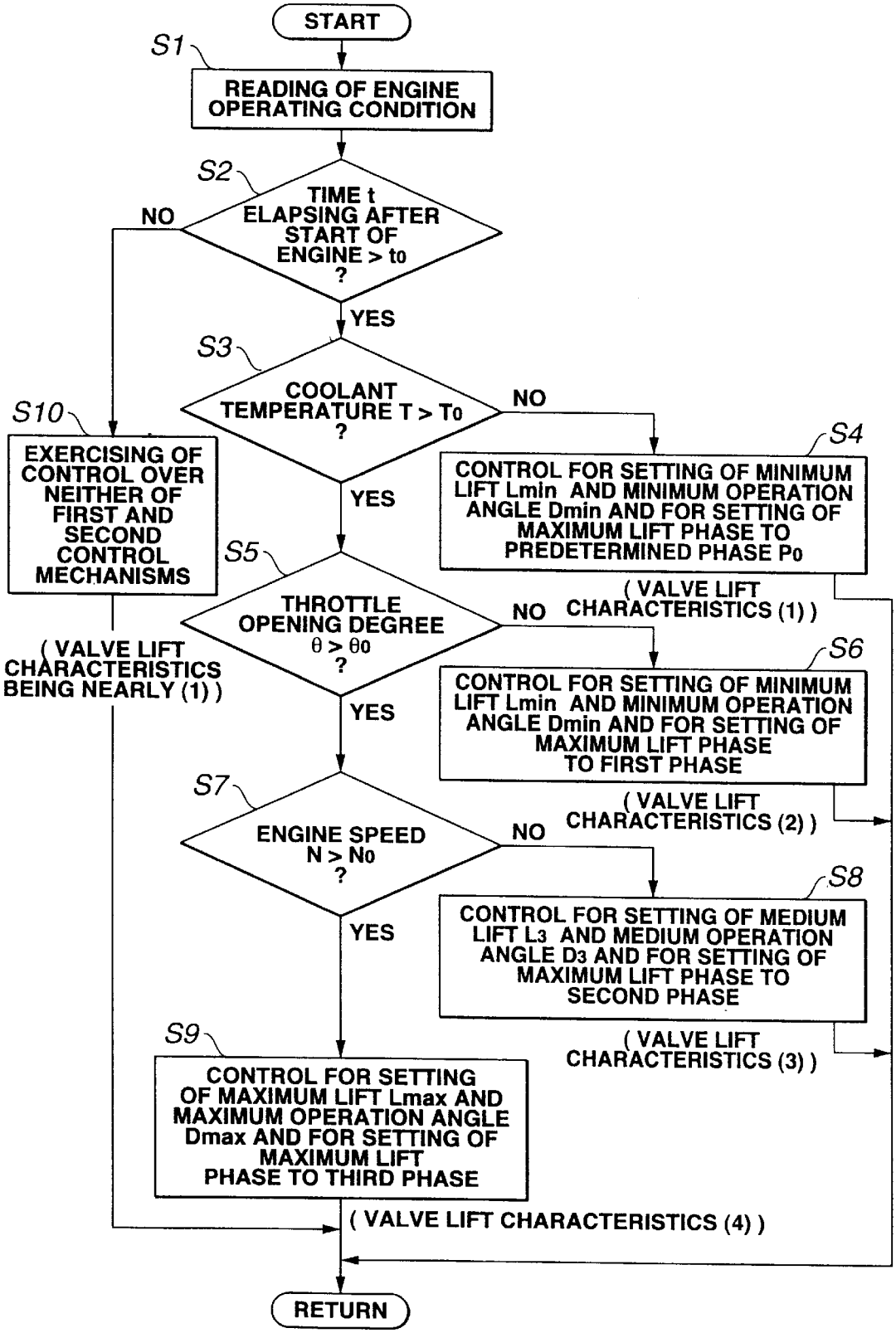
FIG. 7 is a flow chart of a control routine executed by the valve timing and lift control system of FIG. 1.

Then, the control of the first control mechanism 18 and the second control mechanism 20 by means of the controller 72 will be described with reference to the flowchart of FIG. 7.

Firstly, in step S1, an engine speed N, coolant temperature T, throttle opening degree $\theta$, time t elapsing after start of the engine 10, etc. are read from various sensors such as the aforementioned crank angle sensor, throttle opening degree sensor and coolant temperature sensor, i.e., a present engine operating condition is read.

Then, in step S2, it is determined whether or not the time t elapsing after start of the engine 10 is larger than a predetermined time $t_0$. In case it is determined that the time t is shorter than the time $t_0$, a battery voltage and an engine oil pressure are not stable so that the program proceeds to step S10 were control of neither of the first control mechanism 18 and the second control mechanism 20 is exercised, i.e., neither of them are put into action or operated. As a result, as mentioned above, the magnitude of lift and the maximum lift phase are stably regulated to or set at a value adjacent the minimum lift Lmin and an angle adjacent the most advance angle, respectively (refer to the dotted line curve (1) in FIG. 8). The valve lift characteristics (1) are such that the valve lift becomes minimum when an associated piston is at or adjacent TDC (top dead center) and the maximum lift phase is most advanced from TDC. For this reason, an interference between the piston and the exhaust valve 14 and an interference between the exhaust valve 14 and an associated intake valve (not shown) can be avoided assuredly, so that the exhaust valves 14 and 14 are in the most desirable or advantageous condition.

Further, by regulating the magnitude of lift to a value adjacent the minimum lift Lmin and the maxi lift phase at the point adjacent the most advance angle, it becomes possible to avoid an interference between the piston and the exhaust valve 14 even when the valve timing and lift system 12 becomes uncontrollable due to a trouble of an electric system such as breaking of wire or a trouble of a hydraulic system such as leakage of oil.

When it is determined in step S2 that the time t is longer than the time $t_0$, the program proceeds to step S3. In step S3, it is determined whether or not the present coolant temperature T is higher than a predetermined temperature $T_0$. When it is determined in step S3 that T is lower than $T_0$, it is judged or concluded that the engine 10 is cold, i.e., the engine 10 has not yet warmed up, and the program proceeds to step S4. In step S4, the first control mechanism 18 exercises a control for regulating the magnitude of lift to the minimum lift Lmin and the operation angle to the minimum operation angle Dmin, and the second control mechanism 20 exercises a control for regulating the maximum lift phase to the most advance angle, i.e., a predetermined phase $P_0$ (valve lift characteristics (1)).

In the meantime, since the valve lift characteristics before the valve lift control in step S4 is exercised is close or similar to the valve lift characteristics (1), the valve lift control in step S4 causes only a small variation of the valve lift characteristics and does not cause any switching shock and can be completed within a short time though the engine 10 is cold.

When the valve lift characteristics are regulated to or set at those represented by the dotted line curve (1) in FIG. 8, as mentioned above, the exhaust valves 14 and 14 are caused to close early in the middle of the exhaust stroke by the effect of a small operation angle control by the first control mechanism 18 and an advance angle control by the second control mechanism 20. High temperature combustion gas thus can be enclosed within the combustion chamber by the effect of a small lift control of the exhaust valves 14 by the first control mechanism 18. Furthermore, since the piston performs a compression operation thereafter, the temperature within the cylinder is caused to rise efficiently. As a result, the engine 10 can be warmed up rapidly, the coolant temperature can be raised at a high speed, and the ability of heating the passenger compartment can be improved.

Further, by the aforementioned temperature rise of the combustion chamber, the combustion is improved and toxic exhaust emissions from the combustion chamber are reduced. Furthermore, since the opening timing of the exhaust valve 14 becomes relatively earlier due to the above described small operation angle control and phase control, the temperature rise speed of the catalyst disposed at an exhaust pipe becomes faster, thus making it possible to accelerate activation of the catalyst for thereby attaining a high exhaust emission conversion rate and reduce the toxic exhaust emissions from the catalytic converter sufficiently.

Further, in the latter half of the exhaust stroke, an exhaust gas of a high hydrocarbon (HC) concentration existing in the space between the cylinder and piston are emitted from the combustion chamber. However, since the exhaust valve 14 is closed early in the middle of the exhaust stroke as mentioned above, most of the exhaust gas of a high HC concentration is enclosed within the combustion chamber and not emitted to the exhaust system side, thus making it possible to reduce the HC emissions from the combustion chamber and therefore making it possible to attain a good HC emission reducing effect at the outlet of the catalytic converter.

Further, since the first control mechanism 18 is actuated electrically and the second control mechanism 20 is controlled hydraulically, the switching operation can be stable even when the engine 10 is cold. When the engine 10 is cold, there is a tendency that the battery voltage is lowered. However, since the electricity is utilized for the first control mechanism 18 only, a load applied to the battery is small and therefore a switching operation by the electricity can be maintained stable. On the other hand, when the engine 14 is cold, the viscosity of engine oil is high and therefore the switching operation tends to be delayed. However, since it is only the second control mechanism 20 that is operated by oil pressure, the flow rate of working oil necessary for operating the second control mechanism 20 can be small and therefore the switching operation can be stable.

When it is determined in step S3 that the engine coolant temperature exceeds $T_0$, it is judged or concluded that the engine 10 has warmed up to some extent and the program proceeds to step S5. In step S5, it is determined whether or not the present throttle opening degree $\theta$ is larger than a predetermined throttle opening degree $\theta_0$. When it is determined that $\theta$ is smaller than $\theta_0$, for example, at idling, the program proceeds to step S6.

In step S6, from the judgement that the engine 10 has warmed up to some extent, the exhaust valves 14 and 14 are controlled by the first control mechanism 18 so that the magnitude of lift and operation angle are regulated to or set at the minimum lift Lmin and the minimum operation angle Dmin, respectively and by the second control mechanism 20 so that the maximum lift phase is regulated to or set at a first phase which is on the retard angle side of the predetermined phase $P_0$, i.e., which retards from the predetermined phase $P_0$. Namely, the exhaust valves 14 and 14 are controlled by the first and second control mechanisms 18 and 20 so that the valve lift characteristics represented by the solid line curve (2) in FIG. 8 are obtained. By this, the fuel consumption under such an engine operating condition can be improved.

Under the condition where the engine 10 has warmed up to some extent, the same control as that at the time of the engine 10 being cold will possibly deteriorate the fuel consumption. When the high temperature combustion gas is enclosed within the combustion chamber and then compressed in the similar manner to that at the time of the engine 10 being cold, a pumping loss is increased and a resulting increase of the combustion gas temperature increases the cooling loss of the engine 10, thus deteriorating the fuel consumption. Further, though an early opening timing of the exhaust valve 14 is desirable for heating of the catalyst at the time of the engine 10 being cold, an expansion operation for pushing the piston downward is lowered.

Thus, by exercising such a control as in step S6, it becomes possible to reduce the aforementioned cooling loss, prevent the lowering of the expansion operation and suppress a driving loss of a drive system resulting from the minimum lift, thus making it possible to improve the fuel consumption. Further, in case it is determined in step S5 that the throttle opening degree $\theta$ exceeds the predetermined value $\theta_0$, the program proceeds to step S7. In step S7, it is determined whether or not the present engine speed N is higher than a predetermined value $N_0$. In this instance, when it is determined that N is lower than $N_0$, it is judged or concluded that the engine 10 is in a low speed and high load operating condition and the program proceeds to step S8. When it is determined that N is higher than $N_0$, it is judged or concluded that the engine 10 is in a high speed and high load operating condition and the program proceeds to step S9.

In step S8, the exhaust valves 14 and 14 are controlled by the first control mechanism 18 so that the magnitude of lift and the operation angle are regulated to or set at a medium valve lift L3 and a medium operating angle D3, respectively and by the second control mechanism 20 so that the maximum lift phase is regulated to or set at a second phase which is on the retard angle side of the predetermined phase $P_0$, i.e., which retards from the predetermined phase $P_0$. Namely, the exhaust valves 14 and 14 are controlled by the first and second control mechanisms 18 and 20 so that the valve lift characteristics represented by the solid line curve (3) in FIG. 8 are obtained.

By this control, the closing timing of the exhaust valve 14 is delayed and therefore a so-called valve overlap with an associated intake valve whose valve lift characteristics are represented by a dotted line curve (3') in FIG. 8 can be made larger. Thus, by the synergistic effect of a large valve overlap and an exhaust pulsation, a high intake charging efficiency can be attained. Further, since the opening timing of the exhaust valve 14 is regulated or set by the aforementioned medium operation angle control and the retard angle control to the timing which is adjacent BDC and suited to a low speed and low load operating condition, i.e., the timing at which the sum of a blow down loss due to the timing being too early and the scavenge or expel loss due to the timing being too late is small. Thus, together with the aforementioned improved charging efficiency, a large output torque can be obtained.

On the other hand, in step S9, the control by the first control mechanism 18 is further advanced than that in step S8, i.e., the valve lift and the operation angle are regulated to or set at a maximum lift Lmax and a maximum operation angle Dmax, respectively. Simultaneously with this, by the second control mechanism 20, the maximum lift phase is regulated to or set at a third phase which is on the retard angle side of the first phase and on the advance angle side of the second phase, i.e., which is located between the first phase and the second phase. Namely, the exhaust valves 14 and 14 are controlled by the first and second control mechanisms 18 and 20 so that the valve timing and lift characteristics represented by the solid line curve (4) in FIG. 8 are obtained.

Accordingly, by retarding the closing timing of the exhaust valves 14 and 14, the valve overlap can be made larger. Thus, by the synergistic effect with the exhaust pulsation, a high intake charging efficiency can be attained. Further, since the opening timing of the exhaust valves 14 and 14 is regulated or set by the aforementioned large operation angle control and the retard angle control to the timing which is sufficiently earlier than BDC, i.e., the timing at which the sum of a blow down loss due to the timing being too early and the scavenge or expel loss due to the timing being too late is small. Thus, together with the aforementioned improved intake charging efficiency, a large output torque can be obtained. The reason why the timing by this control is earlier than the timing by the control for the low speed and high load operating condition is that the scavenge or expel loss increases considerably at a high speed operating condition.

In the foregoing, it is to be noted that the second phase of the valve timing and lift characteristics (3) (for low speed and high load range) is set on a retard side of the third phase of the valve timing and lift characteristics (4) (for high speed and high load range). The allowable retard angle which is determined by restrictions concerning the interference between the exhaust valve 14 and the piston and the interference between the exhaust valve 14 and the intake valve is large at the time of the medium valve lift and medium operation angle and small at the time of the large valve lift and the large operation angle.

Accordingly, by controlling the valve timing and lift characteristics so that the second phase for the medium valve lift and medium operation angle for the low speed and high load range (valve timing and lift characteristics (3)) is on the retard angle side of the third phase for the high speed and high load range (valve timing and lift characteristics (4)), it becomes possible to improve the output torque while avoiding the interference of the exhaust valve 14, etc. at both of the engine operating conditions.

It is further to be noted that the phase of closing timing (fourth phase) of the exhaust valve 14 according to the valve lift characteristics (3) and the phase of closing timing (fifth phase) of the exhaust valve 14 according to the valve lift characteristics (4) are set so as to be nearly equal to each other, thus making it possible to avoid the interference of the exhaust valve 14, etc. at both of the engine operating ranges and improve the output torque.

From the foregoing, it will be understood that by the first and second control mechanisms the engine performance efficiency can be considerably improved in accordance with the operating condition of the engine. Further, by the minimum operation angle control of the exhaust valve by the first control mechanism and the advance angle control by the second control mechanism, the exhaust valve is closed early in the middle of the exhaust stroke. Simultaneously with this, by the small valve lift control of the exhaust valve by the first control mechanism, high temperature combustion gas is not discharged rapidly but enclosed within the combustion chamber. Thereafter, when the compression by the piston is performed, the temperature within the combustion chamber can be raised rapidly. As a result, it becomes possible to improve the exhaust emission reducing efficiency and the passenger compartment heating efficiency considerably.

The entire contents of Japanese Patent Application No. 2000-179510 (filed Jun. 15, 2000) are incorporated herein by reference.

Although the invention has been described above by reference to an embodiment of the invention, the invention is not Limited to the embodiment described above. Modifications and variations of the embodiment described above will occur to those skilled in the art, in light of the above teachings. The scope of the invention is defined with reference to the following claims.

What is claimed is:

1. A valve timing and lift control system for an internal combustion engine comprising:

a first control means for variably controlling a lift and an operation angle of an exhaust valve of the engine;

a second control means for variably controlling a maximum lift phase of the exhaust valve;

a detector for detecting an operating condition of the engine and producing a signal representative thereof; and a controller for controlling the first control means and the second control means in response to the signal from the detector.

2. A valve timing and lift control system for an internal combustion engine comprising:

a first control mechanism for variably controlling a lift and an operation angle of an exhaust valve of the engine;

a second control mechanism for variably controlling a maximum lift phase of the exhaust valve;

a detector for detecting an operating condition of the engine and producing a signal representative thereof; and a controller for controlling the first control mechanism and the second control mechanism in response to the signal from the detector, wherein when the engine is cold after starting, the first control mechanism regulates the lift and the operation angle of the exhaust valve to a minimum lift and a minimum operation angle, respectively and the second control mechanism regulates the maximum lift phase to a most advance angle point.

3. A valve timing and lift control system for an internal combustion engine comprising:

a first control mechanism for variably controlling a lift and an operation angle of an exhaust valve of the engine;

a second control mechanism for variably controlling a maximum lift phase of the exhaust valve;

a detector for detecting an operating condition of the engine and producing a signal representative thereof; and a controller for controlling the first control mechanism and the second control mechanism in response to the signal from the detector, wherein when the engine is in a warmed-up, low load operating condition, the first control mechanism regulates the lift and the operation angle of the exhaust valve to a minimum lift and a minimum operation angle, respectively and the second control mechanism regulates the maximum lift phase to a point retarded from a most advance angle point.

4. A valve timing and lift control system for an internal combustion engine comprising:

a first control mechanism for variably controlling a lift and an operation angle of an exhaust valve of the engine;

a second control mechanism for variably controlling a maximum lift phase of the exhaust valve;

a detector for detecting an operating condition of the engine and producing a signal representative thereof; and a controller for controlling the first control mechanism and the second control mechanism in response to the signal from the detector, wherein when the engine is in a low speed and high load operating condition, the first control mechanism regulates the lift and the operation angle of the exhaust valve to a medium lift which is intermediate between a minimum lift and a maximum lift and a medium operation angle which is intermediate between a minimum operation angle and a maximum operation angle, respectively and the second control mechanism regulates the maximum lift phase to a retard angle point retarded from a most advance angle point and a phase of closing timing of the exhaust valve to a predetermined retard angle point.

5. A valve timing and lift control system for an internal combustion engine comprising:

a first control mechanism for variably controlling a lift and an operation angle of an exhaust valve of the engine;

a second control mechanism for variably controlling a maximum lift phase of the exhaust valve;

a detector for detecting an operating condition of the engine and producing a signal representative thereof; and a controller for controlling the first control mechanism and the second control mechanism in response to the signal from the detector, wherein when the engine is in a high speed and high load operating condition, the first control mechanism regulates the lift and the operation angle of the exhaust valve to the maximum lift and the maximum operation angle, respectively and the second control mechanism regulates the maximum lift phase to a retard angle point retarded from a most advance angle point and a phase of closing timing of the exhaust valve to a predetermined retard angle point.

6. A valve timing and lift control system according to claim 5, wherein the retard angle point to which the maximum lift phase is regulated when the engine is a low speed and high load operating condition is more retarded than the retard angle point to which the maximum lift phase is regulated when the engine is in a high speed and high load operating condition.

7. A valve timing and lift control system according to claim 5, wherein the predetermined retard angle point to which the phase of closing timing of the exhaust valve is regulated when the engine is in a low speed and high load operating condition and the predetermined retard angle point to which the phase of closing timing of the exhaust valve is regulated when the engine is in a high speed and high load operating condition are nearly equal to each other.

8. A valve timing and lift control system according to claim 1, wherein the first control device allows the lift and the operation angle of the exhaust valve to be respectively maintained adjacent a minimum lift and a minimum operation angle when the first control device halts, and the second control device allows the maximum lift phase of the exhaust valve to be maintained adjacent the most advance angle point when the second control device halts.

9. A valve timing and lift control system according to claim 1, wherein the first control means is operative to vary the lift of the exhaust valve continuously, and the second control means is operative to vary the maximum lift phase continuously.

10. A valve timing and lift control system according to claim 1, wherein one of the first control means and the second control means is actuated by electric power and the other is actuated by hydraulic power.

11. A valve timing and lift control system according to claim 1, wherein the first control means comprises a drive shaft rotatable in timed relation to a revolution of the engine, a drive cam mounted on the drive shaft for rotation therewith, an oscillating cam mounted on the drive shaft for oscillating motion for thereby opening and closing the exhaust valve, a control shaft arranged in parallel with the drive shaft, a control cam mounted on the control shaft for rotation therewith, a rocker arm mounted on the control cam for oscillating motion and having a pivotal axis which is variably controlled by the control cam, the rocker arm being operatively connected at one of opposite ends thereof to the drive cam and at the other of the opposite ends to the other of the opposite ends to the oscillating cam, the control shaft being rotatable to control a rotational position of the control cam for thereby variably controlling the lift and the operation angle of the exhaust valve.

12. A valve timing and lift control system for an internal combustion engine comprising:

a drive shaft rotatable in timed relation to a revolution of the engine;

an oscillating cam mounted on the drive shaft for oscillating motion and operatively engaging an exhaust valve of the engine for opening and closing the exhaust valve when the oscillating cam oscillates;

a connecting device for drivingly connecting the drive shaft to the oscillating cam in such a manner as to convert rotation of the drive shaft to oscillating motion of the oscillating cam;

a first control device for varying engagement of the oscillating cam with the exhaust valve for thereby varying a lift and an operation angle of the exhaust valve;

a second control device for varying a phase of the drive shaft and thereby varying a maximum lift phase of the exhaust valve; and a controller for controlling the first control device and the second control device in response to the signal from a detector, the controller produces separate control signals for the first control device and the second control device respectively.

13. A valve timing and lift control system according to claim 12, wherein the connecting device comprises a drive cam in the form of an eccentric cam, mounted on the drive shaft for rotation therewith, the drive cam having a rotational axis which is offset from a rotational axis of the drive shaft, a control shaft disposed in parallel with the drive shaft, a control cam in the form of an eccentric cam, mounted on the control shaft for rotation therewith, a rocker arm mounted on the control cam for rotation relative thereto and having a pair of opposite end portions on diametrically opposite sides of the control cam, a pivotal link mounted on the drive cam for pivotal motion and having an protruded arm portion which is protruded radially of the drive cam and pivotally connected to one of the opposite ends of the rocker arm, and a connecting rod pivotally connected at one of opposite ends thereof to the other of the opposite ends portions of the rocker and at the other of the opposite ends thereof to the oscillating cam, wherein rotation of the drive shaft causes the rocker arm to oscillate and oscillation of the rocker arm causes the oscillation cam to oscillate, and wherein rotation of the control shaft causes the center axis of the rocker arm to move relative to the rotational axis of the drive shaft and movement of the center axis of the rocker arm relative to the rotational axis of the drive shaft causes the oscillation cam to rotate and engage at a different cam surface portion thereof with the exhaust valve of the engine.

14. A valve timing and lift control system according to claim 12, wherein when the engine is cold after starting, the first control device regulates the lift and the operation angle of the exhaust valve to a minimum lift and a minimum operation angle, respectively and the second control device regulates the maximum lift phase to the most advance angle point.

15. A valve timing and lift control system according to claim 12, wherein when the engine is in a warmed-up, low load operating condition, the first control device regulates the lift and the operation angle of the exhaust valve to a minimum lift and a minimum operation angle, respectively and the second control device regulates the maximum lift phase to a retard angle side which retards a predetermined angle from the most advance angle point.

16. A valve timing and lift control system according to claim 12, wherein when the engine is in a low speed and high load operating condition, the first control device regulates the lift and the operation angle of the exhaust valve to a medium lift which is intermediate between a minimum lift and a maximum lift and an intermediate operation angle which is intermediate between a minimum operation angle and a maximum operation angle, respectively and the second control device regulates the maximum lift phase to a retard angle point which retards a predetermined angle from the most advance angle point and a phase of closing timing of the exhaust valve to a predetermined retard angle point.

17. A valve timing and lift control system according to claim 16, wherein when the engine is in a high speed and high load operating condition, the first control device regulates the lift and the operation angle of the exhaust valve to a maximum lift and a maximum operation angle, respectively and the second control device regulates the maximum lift phase to a retard angle point which retards a predetermined angle from a most advance angle point and a phase of closing timing of the exhaust valve to a predetermined retard angle point.

18. A valve timing and lift control system according to claim 17, wherein the retard angle point to which the maximum lift phase is regulated when the engine is a low speed and high load operating condition is more retarded than the retard angle point to which the maximum lift phase is regulated when the engine is in a high speed and high load operating condition.

19. A valve timing and lift control system according to claim 17, wherein the predetermined retard angle point to which the closing timing of the exhaust valve is regulated when the engine is in a low speed and high load operating condition and the predetermined retard angle point to which the closing timing of the exhaust valve is regulated when the engine is in a high speed and high load operating condition are nearly equal to each other.

20. A valve timing and lift control system according to claim 12, wherein the first control device, when halts, allows the lift and the operation angle of the exhaust valve to be respectively maintained adjacent the minimum lift and the minimum operation angle and the second control device, when halts, allows the maximum lift phase of the exhaust valve to be maintained adjacent the most advance angle point.

21. A valve timing and lift control system according to claim 12, wherein the first control device is operative to vary the lift of the exhaust valve continuously, and the second control device is operative to vary the maximum lift phase continuously.

22. A valve timing and lift control system according to claim 12, wherein one of the first control device and the second control device is actuated by electric power and the other is actuated by hydraulic power.

* * * * *